US005536334A

United States Patent [19]

Kobayashi et al.

[11] Patent Number: 5,536,334

[45] Date of Patent: Jul. 16, 1996

[54] PERMANENT MAGNET AND A MANUFACTURING METHOD THEREOF

[75] Inventors: Osamu Kobayashi; Tatsuya Shimoda; Koji Akioka; Toshiaki Yamagami; Nobuyasu Kawai, all of Suwa, Japan

[73] Assignee: Seiko Epson Corporation, Japan

[21] Appl. No.: 266,995

[22] Filed: Jun. 28, 1994

Related U.S. Application Data

[63] Continuation of Ser. No. 993,450, Dec. 16, 1992, abandoned, which is a continuation of Ser. No. 429,167, Oct. 27, 1989, abandoned, which is a division of Ser. No. 353,254, May 17, 1989, abandoned.

[30] Foreign Application Priority Data

Jun. 2, 1988 [JP] Japan ..... 63-150039
Jun. 20, 1988 [JP] Japan ..... 63-150040

[51] Int. Cl.[6] ..... H01F 1/57

[52] U.S. Cl. ..... 148/101; 148/120

[58] Field of Search ..... 148/101, 120

[56] References Cited

U.S. PATENT DOCUMENTS

| | | | |
|---|---|---|---|
| 4,770,723 | 9/1988 | Sagawa | 148/302 |
| 4,859,254 | 8/1989 | Mizoguchi | 148/302 |
| 4,921,551 | 5/1990 | Vernia | 148/101 |
| 5,125,988 | 6/1992 | Akioka et al. | 148/101 |

FOREIGN PATENT DOCUMENTS

| | | | |
|---|---|---|---|
| 0125752 | 11/1984 | European Pat. Off. . | |
| 0133758 | 3/1985 | European Pat. Off. . | |
| 0197712 | 10/1986 | European Pat. Off. | 148/302 |
| 231620A2 | 8/1987 | European Pat. Off. . | |
| 2586323 | 2/1987 | France . | |
| 63213323 | 9/1986 | Japan | 148/302 |
| 62-23959 | 1/1987 | Japan . | |
| 62-198103 | 9/1987 | Japan . | |
| 62-265705 | 11/1987 | Japan | 148/101 |
| 62-276803 | 12/1987 | Japan | 148/101 |
| 63-114106 | 5/1988 | Japan | 148/101 |
| 63-312915 | 12/1988 | Japan | 148/101 |
| 2206241 | 12/1988 | United Kingdom | 148/101 |

*Primary Examiner*—John Sheehan
*Attorney, Agent, or Firm*—Stroock & Stroock & Lavan

[57] ABSTRACT

This invention relates to a permanent magnet having magnetic anisotropy given by means of a newly developed mechanical alignment and a manufacturing method thereof, and more particularly to a magnet comprising R (at least one rare-earth element selected from tile group consisting of Pr, Nd, Dy, Ce, La, Y and Tb), M (at least one transition metal selected from the group consisting of Fe, Co, Cu, Ag, Au, Ni and Zr) and X (at least one IIIb element of the periodic table selected from the group consisting of B, Ga and Al) and manufacturing method thereof, said alloy of R-M-X series, which composes basic component, are melted and cast, then cast ingot is hot-worked at the temperature above 500° C. to remove or eliminate liquid phase of non-magnetic R-rich phase to concentrate magnetic phase, and to give magnetic anisotropy by means of mechanical alignment. It can provide magnet with excellent property comparable to that of the magnet provided by the conventional manufacturing method while applying cast hot-working heat treatment process which does not includes powdering process.

8 Claims, 6 Drawing Sheets

PERMANENT MAGNET AND A MANUFACTURING METHOD THEREOF

This is a continuation of application Ser. No. 07/993,450 filed Dec. 16, 1992 (abandoned) for PERMANENT MAGNET AND A MANUFACTURING METHOD THEREOF, which is a continuation of application Ser. No. 07/429,167 filed Oct. 27, 1989 (abandoned), which is a divisional of application Ser. No. 07/353,254 filed on May 17, 1989 (abandoned).

BACKGROUND OF THE INVENTION

This invention generally relates to a permanent magnet having magnetic anisotropy by means of mechanical orientation, and a manufacturing method thereof. More particularly, the present invention relates to a permanent magnet comprising R (R being at least one element selected from the group consisting of rare earth elements including Yttrium (Y)), M (M being at least one element selected from the group consisting of transition elements such as Fe, Cu, Au and Zr) and X (X being at least one element selected from the group consisting of B, Al and Ga).

Permanent magnets are important electric-electronic materials which are used in a wide range of fields such as in domestic appliances and in peripheral equipment for computers. In pursuit of the present users' desire for miniaturization and the improved of efficiency of permanent magnets, higher performance permanent magnets have been required.

Permanent magnets are made of a material which can produce magnetic fields without applying electric power, has a high coercive force, and has a high residual magnetic flux density. These requirements are quite different from high permeability magnetic material, which is currently used in magnets of the Alnico series, barium-ferrite and the rare-earth transition metal series.

In particular, permanent magnets of the rare-earth transition metal series, such as R-Co or R-Fe-B magnets, have high magnetic properties having very high coercive forces, and energy-product values, therefore, much research and development has been carried out on them.

Described below are several references concerning high performance anisotropic permanent magnets of the rare-earth-iron (transition metal) series and their manufacturing method:

(1) Japanese patent application disclosure No. 59-46008 (equivalent to EP 101552A and U.S. Pat. No. 4,770,723), and in the reference by M. Sagawa, S. Fujimura, N. Togawa, H. Yamamoto and Y. Matsuura (J. Appl. Phys. Vol. 55(6), 15 Mar. 1984, p. 2083), disclose permanent magnets which are characterized by a magnetically anisotropic sintered substance comprising 8–30 atomic % of R (R being at least one element selected from the group consisting of rare-earth elements including Y) and residual of iron(Fe). This substance is manufactured by means of a sintering method of powder metallurgy.

In this sintering method, the manufacturing process comprises preparing an alloy ingot by means of melting and casting, providing magnetic powder of suitable grain size by means of grinding, blending said powder with an additive binder for forming and forming a green body by press-forming in a magnetic field. After pressing, the green body is sintered in an argon atmosphere at a temperature of 1100 degree centigrade for about one hour, and after that, the product is rapidly cooled to room temperature. After sintering, the product is heat-treated at 600 degree centigrade to improve its coercive force.

(2) Japanese patent application disclosure No. 59-211549 (equivalent to EP125752), and the reference by R. W. Lee (Appl. Phys. Lett. vol. 46(8), 15 Apr. 1985, p790) disclose a resin-bonded rare-earth-iron magnet which is formed from fine particles of alloy ribbon prepared by means of the melt-spinning method, having a fine crystalline magnetic phase and comprising at least one rare earth element selected from the group consisting of neodymium, praseodymium and mesh metal, transition metal elements, and iron and boron. The fine particles are formed in the desired shape of a magnet by a binder mixed with the particles, the fine particle being magnetically isotropic and the formed magnet being magnetized to any desired direction in a proper magnetic field. The magnet has a density of at least 80% of the alloy density and an energy product of at least 9 megagauss-oersted.

The permanent magnet is manufactured by means of the resin-bonding method using rapidly quenched thin ribbon prepared by the melt spinning method having a process comprising rapidly quenching thin ribbon of about 30 micrometer thickness by means of a melt spinning apparatus used to provide an amorphous alloy.

In the resin bonding method, using a rapidly-quenched ribbon prepared by the melt-spinning method, a first rapidly-quenched thin ribbon of R-Fe-B alloy is prepared by means of a melt spinning apparatus. The obtained ribbon of 30 micrometer thickness is an aggregate of crystal having a diameter of less than 1000 micrometers, and is brittle, and easily breakable, and the crystals are distributed homogeneously so that it has an isotropic magnetic property. It is able to obtain a magnet of density of more than 85% by means of press forming pulverized particles obtained by pulverizing the thin ribbon to a desired grain size with a resin under a pressure of about 7 tons/cm$^2$.

(3) Japanese patent application disclosure No. 60-100402 (equivalent to EP 133758A), and in the reference of R. W. Lee; (Appl. Phys. Letter. Vol. 46(8), 15 Apr. 1985, p790.). These references describe:

(a) Isotropic permanent magnets comprised of fully densified fine particles characterized in that the magnet being provided by hot pressing amorphous or fine particle material comprises iron, neodimium and/or praseodimium and boron.

(b) Anisotropic permanent magnets consisting of fine particles characterized by providing a magnet by hot pressing and hot die upsetting a material comprising iron, neodimium and/or praseodymium and boron, the desirable magnetizing direction of the magnet being parallel to the upset compression direction.

(c) Permanent magnets characterized by a magnet formed by high temperature plastic deforming of an amorphous or fine particle alloy comprising substantially 50~90 atomic % of iron, 10~50 atomic % of neodymium and/or praseodymium and 1~10 atomic % of boron in which the desirable magnetizing direction is perpendicular to the plastic flow in the deformation.

These references also disclose a method of manufacturing a permanent magnet, wherein the permanent magnet is anisotropic and characterized by being composed of iron-rare-earth metals. The manufacturing method comprising heat treating amorphous or fine grained solid particles, including iron, neodymium and/or praseodymium and boron, to prepare a plastically deformed body of fine grained microstructure, and cooling the body.

The manufacturing method of these magnets is a method to manufacture R-Fe-B magnet having anisotropic properties and having a high density by means of a 2-step hot-pressing method in a vacuum or in an inert-gas atmosphere from a ribbon-like rapidly-quenched thin ribbon or plate.

In this pressing process, one-axial pressure is applied to align the magnetization direction parallel to the pressing axis to prepare an anisotropically magnetizable alloy.

Also, it is preferable that the particle grain size of the ribbon-like thin plate be preliminarily manufactured by the melt-spinning method and may be prepared smaller than the grain size showing maximum coercive force to give optimum grain size after the grain-growth in the hot-press process.

(4) Finally, Japanese patent application disclosure No. 62-276803 (equivalent to DE3626406A or U.S. patent application No. 06/895,653) discloses a permanent magnet of a rare-earth-iron system which is characterized by melting an alloy comprising 8~30 atomic % of R (at least one element selected from the group consisting of rare-earth elements including Y), 2~28 atomic % of boron, less than 50 atomic % of cobalt, less than 15 atomic % of aluminum and rest iron and impurities. The alloy is casted and hot-worked at a temperature above 500° C. so as to refine the crystal grain and orient crystal axis to a specific direction to make a magnetic anisotropic cast alloy.

The permanent magnet of R-Fe-B system described above in sections (1) to (4) have drawbacks described below.

The manufacturing method described in the references of section (1), it is indispensable to pulverize the alloy, and because of that, the R-Fe-B alloy is very active to oxygen, and when it is pulverized, the power becomes highly oxidized.

Also, in the process of the forming the powder, it is necessary to add forming additive such as zinc stearate, although this additive may be removed preliminarily before the sintering process, some part of the additive remains in the magnet body in the form of carbon, and it is not desirable because this residual carbon deteriorates the magnetic properties of the R-Fe-B magnet.

The formed body, which is called a green body, is very difficult to handle because it is easy to break. Thus, the handling is very troublesome when the formed bodies are arranged in the sintering furnace.

As a result of these drawbacks, the manufacturing cost of a magnet of a R-Fe-B series, is expensive because it is not only necessary to provide expensive equipment, but in addition the manufacturing method thereof does not have good productivity. Thus, it is not able to effectively utilize of an advantage of a R-Fe-B series magnet, i.e., cheap raw materials.

The permanent magnets described in sections (2) and (3) are manufactured by means of vacuum-melt spinning machine. This machine is not only very expensive, but also has very low productivity.

The permanent magnet describe in section (2) is also disadvantaged in that the temperature characteristic and the application thereof because it has homogeneous magnetic properties so that it is a low energy product and also has bad squareness of the hysteresis loop.

The manufacturing method described in section (3) is a unique one which utilizes hot-pressing in two-steps, but when used for mass-production, it is inefficient.

Furthermore, coasening of the crystal grains is remarkable if the temperature rises above 800° C. Because of which, the intrinsic coercive force iHc becomes extremely low so that it is not able to provide a practical permanent magnet.

With respect to the manufacturing method described in section (4), it has the drawback that the manufactured magnet has somewhat inferior magnetic properties compared with that of the magnets manufactured in accordance with references described in sections (2) or (3), although it does not include a pulverizing process and has only one hot-press process thus reducing the manufacturing process to its maximum extent.

SUMMARY OF THE INVENTION

The object of the present invention is to overcome the disadvantages in the traditional techniques hereinabove described, in particular, the characteristics of the permanent magnet manufactured in accordance with the reference described in section (4). Another object of the present invention is to provide an inexpensive permanent magnet having excellent characteristics and the manufacturing method thereof.

The present invention relates to a permanent magnet of the type which comprises, R(rare-earth elements) M(transition elements, and X(Group IIIb elements, such as B, Al or Ga) and the manufacturing method thereof. More particularly, the present invention relates to a permanent magnet which is characterized by raw material to make an alloy ingot, the raw material being basically comprised by R (at least one rare-earth element selected from the group consisting of Pr, Nd, Dy, Ce, La, Y and Tb), M (at least one transition element selected from the group consisting of Fe, Co, Cu, Ag, Au, Ni and Zr), X (at least one of the IIIb elements of the periodic table of B, Ga and Al), in which said R-rich liquid phase of non-magnetic substance is eliminated to condense the magnetic phase and to give magnetic anisotropy by means of mechanical alignment.

The present invention also relates to the method of manufacturing a permanent magnet characterized by melting and casting the alloy of the basic raw material, hot-working the cast ingot at the temperature above 500° C. to eliminate a non-magnetic R-rich liquid phase, concentrate the magnetic phase and give magnetic anisotropy by means of mechanical alignments.

More particularly, the permanent magnet is characterized by a basic component comprised by from 12 to 25 atomic % of R, from 65 to 85 atomic % of M and 3 to 10 atomic % of X, and by eliminating the non-magnetic R-rich liquid phase to concentrate the magnetic phase of from 10 to 18 atomic % of R, from 72 to 87 atomic % of M and from 3 to 10 atomic % of X and giving magnetic anisotropy by means of mechanical alignment.

Also the manufacturing method of aforesaid permanent magnet is characterized by melting and casting an alloy of the basic component, then hot-working at a temperature above 500° C. to reduce or eliminate the non-magnetic R-rich liquid phase and to concentrate the magnetic phase comprising from 10 to 18 atomic % of R, from 72 to 87 atomic % of M and from 3 to 10 atomic % of X and giving magnetic anisotropy by means of mechanical alignment.

It is also the object of the present invention to provide a permanent magnet having a crystal grain size of 0.3~50 μl and having a concentration of less than 10% (not including 0%) of the R-rich phase.

Furthermore, the present invention relates to a permanent magnet characterized by the low material of the basic component thereof being comprised of from 12 to 25 atomic % of Pr, from 65 to 85 atomic % of Fe and 3 to 10 atomic % of B, in which the magnetic phase is comprised of 10 to 18 atomic % of Pr, 72 to 87 atomic % of Fe and 3~10 atomic % being concentrated, and providing a magnetic anisotropic permanent magnet having a crystal grain size of from 0.3 to 50 μm and have less than 10% (not including 0%) of the R-rich phase by means of mechanical alignment.

In addition, the manufacturing method thereof is characterized by melting and casting the basic low materials, hot working the cast ingot at a temperature above 500° C. to reduce or eliminate the non-magnetic R-rich phase and to concentrate the magnetic phase comprising from 10 to 18 atomic % of Pr, from 72 to 87 atomic % of Fe and from 3 to 10 atomic % of B, to provide an anisotropic permanent magnet by means of mechanical alignment and having a grain size of from 0.3 to 150 μm and the ratio of the R-rich phase of less than 10% (not including 0%).

Furthermore, the present invention is directed to a method of manufacturing the permanent magnet described above, in which after the hot working of the case ingot, the material is heat-treated and also, one of the hot working being selected from the group consisting hot-press, hot-rolling and extrusion is performed.

The permanent magnet and manufacturing method thereof, according to the present invention is effective as described below:

(1) It is able to raise crystal alignment along the C-axis to substantially improve the residual magnetic flux density Br, and also by refining the particle size of the crystal coercive force and the maximum energy product (BH) max can be substantially raised.

(2) Manufacturing cost is inexpensive because of a simple manufacturing process.

(3) It is able to improve corrosion resistance because the magnet is less active to the oxygen owing to the low concentration of oxygen in the magnet body.

(4) Manufacturing cost can be reduced because of a good machinability thereof.

(5) The number of working steps and amount of investment can be substantially reduced compared with the conventional sintering manufacturing method.

(6) A low-cost magnet with excellent performance can be provided compared with the manufacturing method of the magnet using the conventional melt-spinning method.

DESCRIPTION OF THE PREFERRED EMBODIMENT

Figure 1:
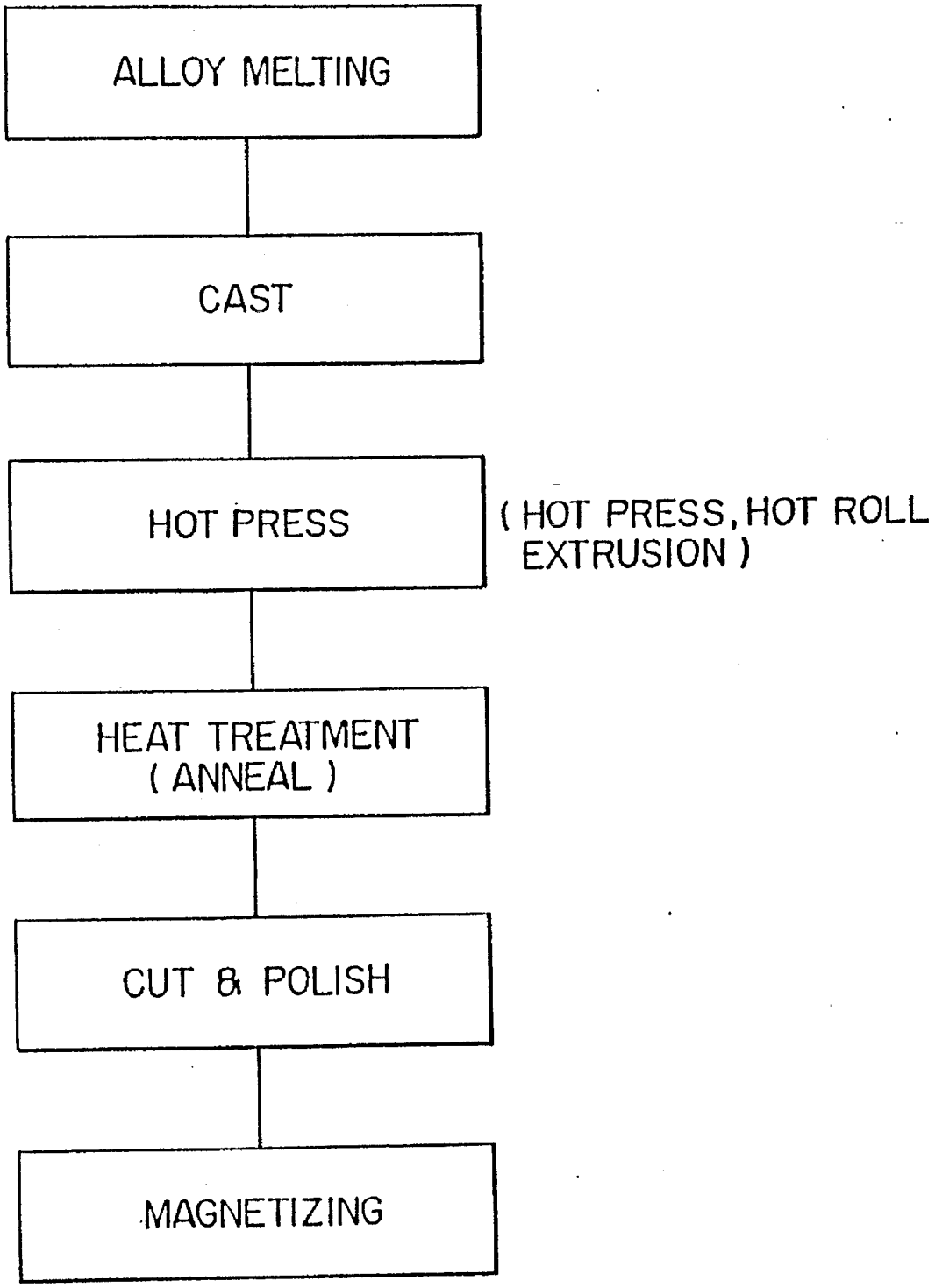
FIG. 1 is a manufacturing process chart of the magnet of R-Fe-B series according to the invention.

The inventors achieved this invention after the evaluation of many kinds of cast alloys of R-Fe-B series and acquired the knowledge that when an appropriate heat treatment is applied to an alloy of Pr-Fe-B series, a high coercive force can be obtained, and further, improvements of the magnetic characteristics of the alloy can be obtained by means of hot-pressing.

Thus, in accordance with the invention, a permanent magnet is provided in which the magnet comprises an alloy of R-M-X series, R being at least one element selected from the group consisting of Pr, Nd, Dy, Ce, La, Y and Tb, M being at least one element selected from the group consisting of Fe, Co, Cu, Ag, Au, Ni and Zr, and X being at least one element selected from the group consisting of B, Al and Ga. The process of manufacturing the magnet is characterized by melting and casting the alloy, and hot-working the cast alloy at a temperature above 500° C. to concentrate the magnetic phase by removing or eliminating the non-magnetic R-rich phase and providing magnetic anisotropy by mechanical alignment. In accordance with this process, which comprises casting, hot-working, and heat-treatment, and does not include powder process, it is possible to provide an excellent magnet comparable to that obtained by the traditional manufacturing method.

In accordance with the invention, a permanent magnet is provided by the process (a)~(c) shown in FIGS. 2(*a*)–(*c*), which are more fully described later.

As a result of squeezing outside the nonmagnetic R-rich liquid phase from the initial R-M-X basic material by hot-working such as hot-pressing, carried out at a temperature above 500° C., and preferably at 750°~1050° C., ferromagnetic particles are concentrated, and only the particle phase is refined and aligned. This enforces the magnetic properties.

In the manufacture of the magnet, a composition adjustment is made to embody stoichiometric $R_2Fe_{14}B$ (in atomic percentage) or $R_{11.7}Fe_{82.4}B_{5.9}$ (in atomic percentage), but when R is rich, the R-rich phase comprises a non-magnetic phase, and also, when B is rich, the B-rich phase acts as a non-magnetic phase.

In this invention, the R content is prepared a little greater than the stoichiometric content so the R-rich phase can be considered as a non-magnetic phase, but when the B content is a little greater than the stoichiometric content, obviously the B-rich phase can be considered as a non-magnetic phase.

Following are the reasons for the composition limit of the basic components R, M and X of the raw material:

R:12~25%

When R is below 12%, the quantity of the R-rich phase becomes too small and makes hot-working difficult. Also, when R exceeds 25%, the quantity of the non-magnetic phase becomes too high and results in poor concentration of the magnetic phase, thereby adversely affecting the magnetic properties.

M:65~85%

When M exceeds 85%, the R-rich phase is smaller and causes hot-working difficulties. Also, when M is below 65%, the quantity of the non-magnetic phase becomes too high and results in a poor concentration of the magnetic phase.

X-3–10%

When X is below 3%, the quantity of the magnetic phase becomes too small and cannot provide high performance. Also, when X exceeds 10%, the non-magnetic phase becomes too high and also hot working becomes difficult.

The basic composition of raw materials as specified above gives a product composition after hot working of R: 10~18%, M: 72~87%, X: 3~10%, which are the composition ranges which provide excellent magnetic properties in accordance with the invention.

Further, in accordance with the invention, the crystal grain size is limited in the range between 0.3~150 μm, the reason of which is as described below:

A crystal grain size of 0.3 micrometer is the critical radius of a single magnetic domain particle, and when the particle size is smaller than 0.3 μm, the initial magnetizing curve is equal to that of the permanent magnet made by the traditional manufacturing method described hereinbefore in section (3).

Also, when the crystal grain size exceeds 150 μm, the resulting magnet, after hot-working, has a coercive force lower than 4KOe, and is practically useless.

Further, as will be shown later, 4πIs (solid line of FIG. 3) increases when the non-magnetic R-rich phase content is lowered. Also, when the R-rich phase content increases, 4πIs decreases, so that the R-rich phase must be kept below 10% for practical applications. But if the R-rich phase is 0%, it loses coercive force, therefore, it should be limited between 0% and 10%.

Several embodiments of the invention are now described.

EMBODIMENTS

Embodiment 1

A process chart of the manufacturing method according to the invention is shown in FIG. 1.

In this embodiment, for the hot working process, mainly hot-pressing was carried out at a temperature of 1000° C. to align the crystal grains of the alloy. The hot-pressing is controlled to minimize the strain rate. Also, the C-axes of the crystal grains are aligned parallel to the compression direction of the alloy.

At first, following the manufacturing process shown in FIG. 1, an alloy comprising $Pr_{17}Fe_{76}0.5B_5Cul._5$ was melted in an induction furnace having an argon atmosphere and then cast as an ingot.

The purity of each of the rare-earth, iron and copper, was over 99.9%, and for the boron, ferroboron is used.

Figure 2A:
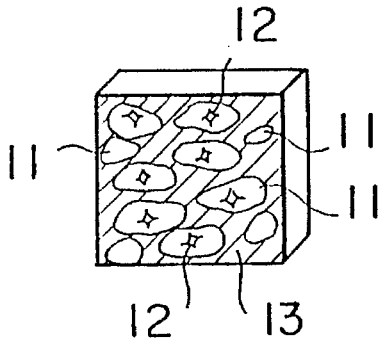
FIG. 2 is a schematic illustration showing an effect of this invention.
Figure 2B:
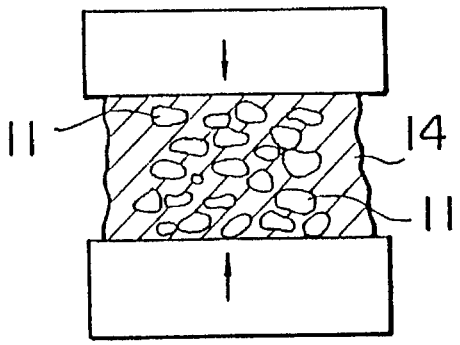
Figure 2C:
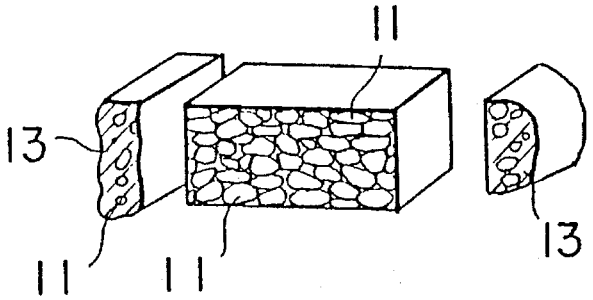

Then, the cast ingot is hot-pressed, as shown in FIG. 2(*b*), an open die in an argon atmosphere at a temperature of 1000° C. to obtain a thickness reduction of 80%. Compressing pressure in this process had a value between 0.2 and 0.8 ton/cm$^2$ and the strain rate was between $10^{-3}$ and $10^{-4}$/sec.

Then, annealing for 24 hours was done at a temperature of 1000° C. and the workpiece was polished to measure its magnetic properties.

The magnetic and other properties of the magnet are shown in table 1 with some reference data showing values obtained from a traditional sintered permanent magnet ($Nd_{15}Fe_{77}B_8$) made as described in section (1) and ($Nd_{13}Fe_{82.6}B4.4$) of section (3).

Further, magnetic properties were measured by a B-H tracer of maximum applied magnetic field of 25kOe.

TABLE 1

| | invented magnet (embodiment 1) | conventional magnet (1) | conventional magnet (3) |
|---|---|---|---|
| raw mat'l magnet composition | $Pr_{17}FE_{76.5}B_5Cu_{1.5}$ $Pr_{13.5}Fe_{79.6}B_{6.3}Cu_{0.9}$ | $Nd_{15}Fe_{77}B_8$ same above | $Nd_{13}Fe_{82.6}B_{4.4}$ same above |
| Br(KG) | 12.5 | 12.5 | 11.75 |
| iHc(kOe) | 9.9 | 13.8 | 13.0 |
| BHmax (MGOe) | 36.2 | 37.7 | 32.0 |
| Avg. grain size | 22 | 20 | ~0.02 |
| 02(ppm) | 210 | 2900 | 900 |
| C(ppm) | 200 | .820 | 1000 |
| porosity | 0.2 | 2.7 | 0.2 |
| R-rich phase ratio (%) | 5.2 | 8.1 | 3.8 |
| magnetization | good | good | bad |

As shown in table 1, it is obvious that the magnet produced by using the invention is not inferior to the conventional permanent magnet described in sections (1) and (3) in magnetic properties and is superior in the magnetizing property.

Further, adding copper to the cast magnet is very effective to improve the coercive force and it is also effective for the improvement of magnetic alignment.

The permanent magnet according to the invention differs from the sintered permanent magnets described in section (1) in Oxygen and Carbon content and in porosity, and differs from the permanent magnet section (2) in the grain size of the crystals, and is superior in its magnetization.

Structure aspects of the magnet according to this invention are now described in connection with FIGS. 2(*a*)–(*c*) which show a magnet including $Pr_2Fe_{14}B$ phase particles 11, an α-Fe phase 12, an R-rich phase 13, and an R-rich liquid phase 14.

FIG. 2(*a*) shows the condition of the main phases after melting and casting an alloy comprising $Pr_{17}Fe_{76.5}B_5Cu1.5$, and as shown in the figure, a small amount of α-Fe phase 12 is included within the $Pr_2Fe_{14}B$ phase grain 11.

Also, among the $Pr_2Fe_{14}B$ phase grain 11, a non-magnetic R-rich phase 13 is present.

FIG. 2(*b*) shows the condition during the hot-pressing process in an open die, during which, at the temperature of 800°~1050° C., the R-rich phase 13 is melted and changed into the R-rich liquid phase 14, and the R-rich liquid phase 14 is removed by the pressure applied through the hot-working, such as hot-pressing, and squeezed to the ouside of the ingot.

Also, the α-Fe phase 12 is diffused and disappears, the $Pr_2Fe_{14}B$ phase grain 11 is pulverized during the hot-press working, and the crystal alignment along the C-axis is aligned with the direction of compression.

FIG. 2(*c*) shows the magnet, in which the squeezed out R-rich phase 13 portion is cut away and the central portion containing the fine $Pr_2Fe_{14}B$ phase particle 11 comprises the magnet.

The space between each $Pr_2Fe_{14}B$ phase grain is filled with an R-rich phase 13, iron and copper. It is obvious that the quantity of the filling material is much reduced compared with that of the cast ingot, and that the magnetic $Pr_2Fe_{14}B$ phase grain is much concentrated compared with that of the initial ingot.

Figure 3:
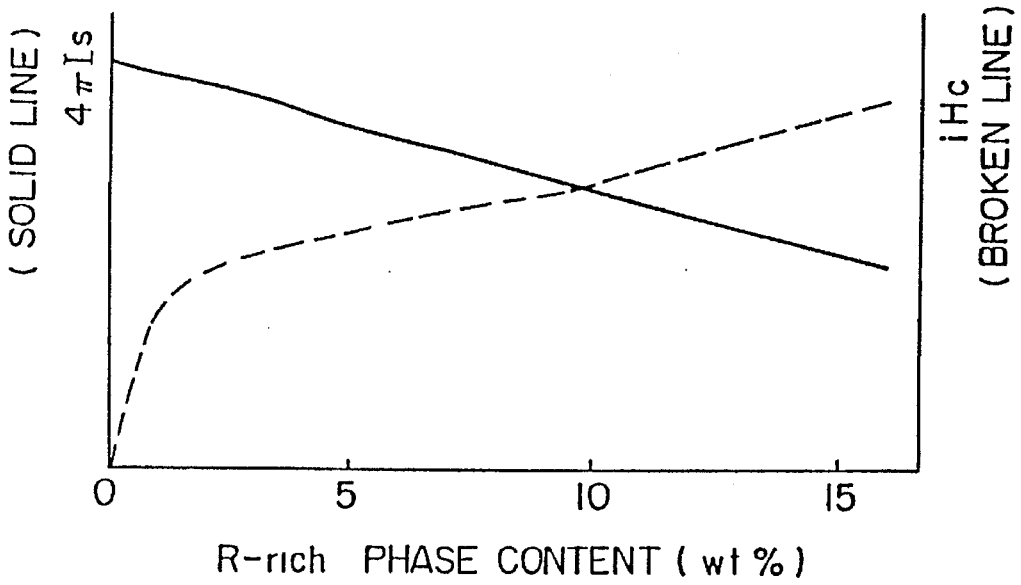
FIG. 3 is a graph showing relation between contention of R-rich phase and 4πIs and iHc.

In FIG. 3, the relation between the content of the R-rich phase of the magnet and 4πIs and iHc are shown. Also, in FIG. 4, 4πI-H curves of a magnet comprised of $Pr_{17}Fe_{76.5}B_5Cu_{1.5}$ are shown for directions parallel and perpendicular to the pressing direction.

FIG. 3 shows that 4πIs (solid line) increases when the quantity of the non-magnetic R-rich phase decreases. Because 4πIs decreases when the quantity of the R-rich phase increases, it is desirable that the quantity thereof be below 10%.

Figure 4:
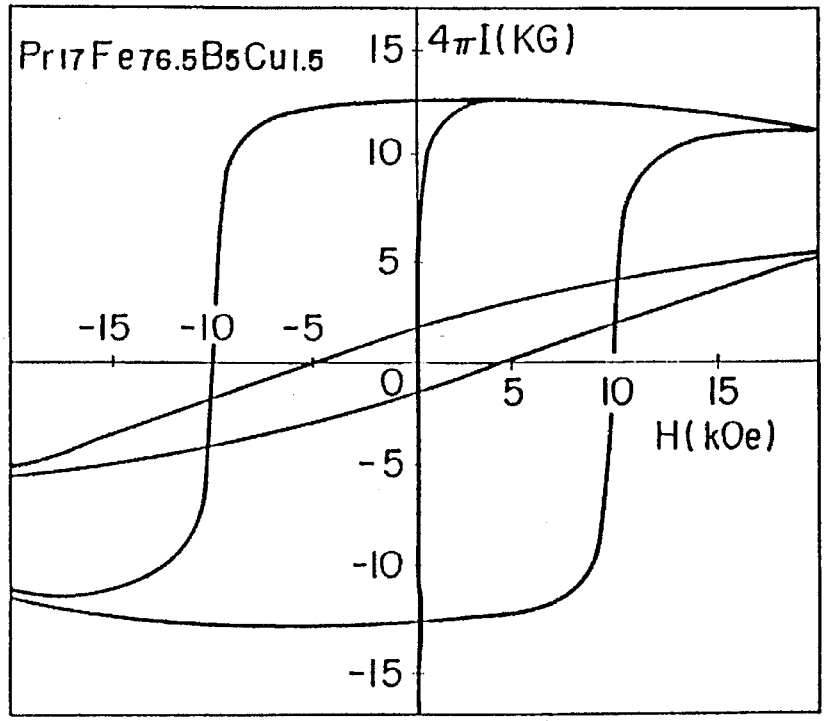
FIG. 4 is a diagram showing two 4πI-H curve of the magnet according to the invention and each curve showing respectively a curve of two orientation one of which is parallel to the compression direction and the other perpendicular thereto after the hot-pressing process.

FIG. 4 shows two kinds of demagnetizing curves of the hot-pressed Pr-Fe-B-Cu magnet measured in easy and hard magnetization directions.

From FIG. 4, it can be seen that the easy magnetization direction is parallel to the compression direction, i.e. c axis. From the initial magnetizing curve, it may be determined that this magnet has a nucleation type coercive force mechanism.

This magnet has the same direction of anisotropy as, but a different coercive force mechanism than the conventional magnet described in section (3).

Embodiment 2

An alloy comprising $Pr_{17}Fe_{79}B_4$ was melted by means of an induction furnace in an argon atmosphere in accordance with the process shown in FIG. 1 and cast as an ingot.

The purity of the iron and rare-earth used was over 99.9% and for the boron, ferroboron was used.

Then, the cast ingot was hot pressed, as shown in FIG. 2(*b*), in an argon atmosphere to make an 80% thickness reduction. Compression pressure in this work has 0.2~0.8 ton/cm$^2$ and the strain rate was $10^{-3}$–$10^{-4}$/sec.

After these treatments, the magnetic properties were measured and, after annealing at 1000° C. for 24 hours, the magnetic properties were measured again.

Table 2 shows the magnetic properties measured before and after the annealing, and in table 3 several magnetic properties after the annealing are shown.

Figure 5:
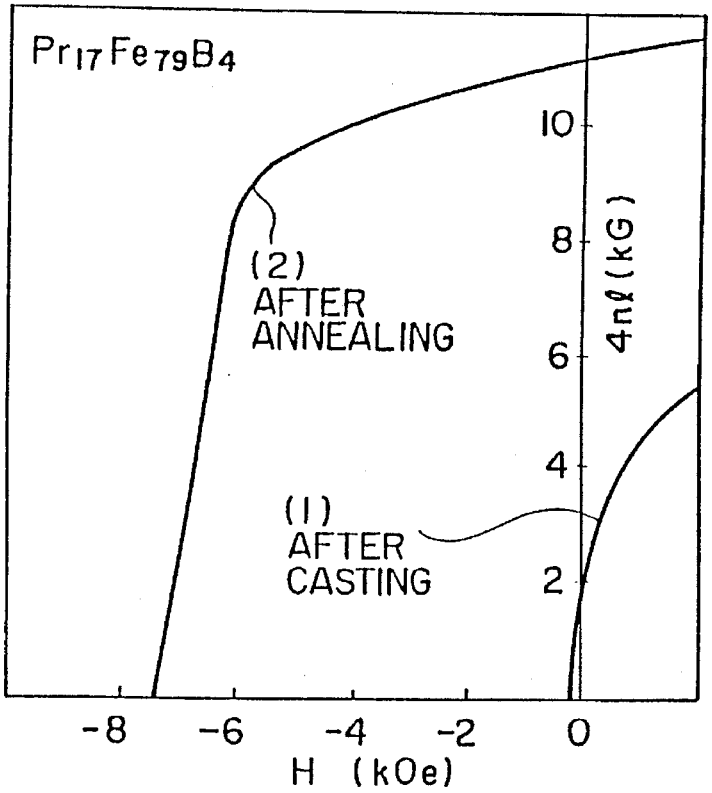
FIG. 5 shows demagnetizing curves of the cast ingot before and after annealing.

Further, in FIG. 5, a demagnetizing curve (1) of the cast ingot and that (2) of the magnet after annealing are shown.

TABLE 2

| | Br (KG) | iHc(KOe) | (BH)max(KOe) |
|---|---|---|---|
| before anneal | 10.6 | 3.6 | 14.3 |
| after anneal | 10.8 | 7.3 | 22.2 |

TABLE 3

| | |
|---|---|
| low material composition | $Pr_{17}Fe_{79}B_4$ |
| magnet composition | $Pr_{14.8}Fe_{80.3}B_{4.9}$ |
| avg. particle size | 20 |
| oxygen O (ppm) | 250 |
| carbon C (ppm) | 180 |
| porosity (%) | 0.2 |
| R-rich phase ratio (%) | 7.9 |
| magnetization | good |

As shown in Table 3, the magnetic phase is concentrated as shown in the difference between the raw-material composition of $Pr_{17}Fe_{79}B_4$ and the magnet composition of $Pr_{14.8}Fe_{80.3}B_{4.9}$. Also, the magnetic properties show excellent values and more particularly, as shown in table 2 and FIG. 5, it is obvious that the magnetic properties can be enhanced by means of annealing.

Figure 6:
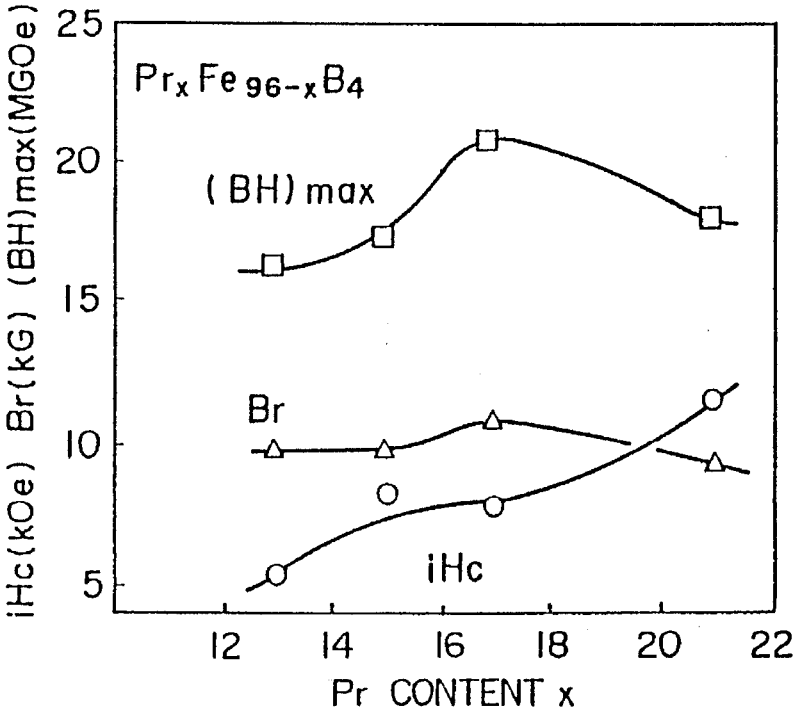
FIG. 6 and FIG. 7 show, respectively, the relation between Pr content and magnetic characteristics and that of B content and magnetic properties of respective magnets.
Figure 7:
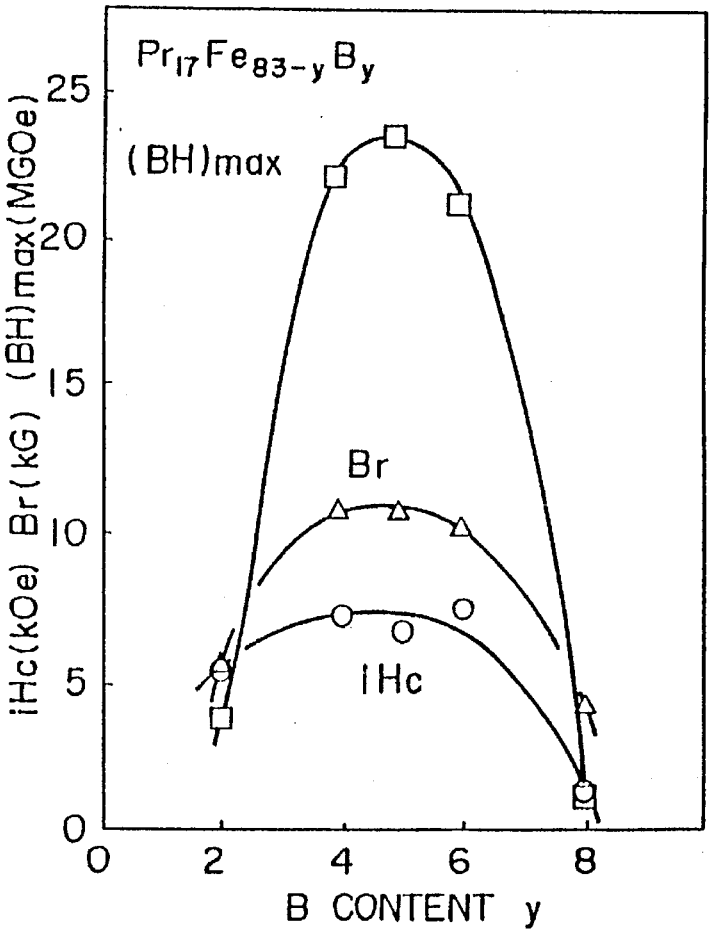

Further, when the cast ingot is prepared with the same manufacturing condition but with changed quantities of Pr and/or B, properties of the magnet thus produced are changed as shown in FIG. 6 and FIG. 7.

FIG. 6 and FIG. 7 show the composition dependency of the hot-pressed magnet, in which all the measurements are made in the orientation which is parallel to that of the pressing. Also, it is easily understandable that the magnet is anisotropic because the value (BH) max (MGo) is greatly enhanced.

Embodiment 3

An alloy having a composition of $Pr_2Nd_5Fe_{79}B_{5.5}Cu_{1.5}$ was melted and cast to provide a cast ingot by means of the process described in Embodiments (1) and (2).

After that, the cast ingot was hot-pressed at a temperature of 1000° C. at the strain rate of $10^{-3}$–$10^{-4}$/sec. with a thickness reduction of 80%.

After 1000° C., 24 hours annealing, the alloy was cut and polished and the magnetic properties of the magnet of a composition of $Pr_{9.5}Nd_4Fe_{80.1}B_{6.1}Cu_{0.8}$ were measured.

The magnetic and other properties of the magnet are tabulated in Table 4.

As shown in Table 4, it is obvious that the magnetic properties thereof are excellent.

TABLE 4

| | |
|---|---|
| Composition of raw material | $Pr_{12}Nd_5Fe_{79}B_{5.5}Cu_{1.5}$ |
| Composition of magnet | $Pr_{9.5}Nd_4Fe_{80.1}B_{6.1}Cu_{0.3}$ |
| Br (KG) | 12.5 |
| iHc (KOe) | 8.8 |
| (BH) max (KGOe) | 33.1 |
| Oxygen O (ppm) | 230 |
| Carbon C (ppm) | 190 |
| Porosity (%) | 0.2 |
| R-rich phase ratio (%) | 5.1 |
| avg. particle size (μm) | 24 |
| magnetizing | good |

Embodiment 4

Alloys as shown in Table 5 were melted and cast in the same way as in Embodiments 1–3.

Then, these cast ingots were hot-pressed in an open die in an argon atmosphere and annealed. After cutting and polishing, magnetic properties of the materials were measured. Compositions of the magnets are shown in Table 6, and several magnetic properties are shown in Table 7.

TABLE 5

| No. | Alloy Composition |
|---|---|
| 1 | $Pr_{15}Fe_{80}B_5$ |
| 2 | $Pr_{10}Fe_{75.5}B_{5.5}$ |
| 3 | $Pr_{22}Fe_{72}B_6$ |
| 4 | $Pr_{10}Nd_7Fe_{75}Co_4B_4$ |
| 5 | $Pr_5Nd_{14}Fe_{67}Co_8B_5Cu_1$ |
| 6 | $Pr_8Nd_8Fe_{71}Co_5B_{5.5}Cu_5Ga_1$ |
| 7 | $Pr_{10}Nd_5Dy_3Fe_{75}B_5Cu_2$ |
| 8 | $Ce_2Pr_{15}Nd_2Fe_{50}Co_{25}B_4Cu_1Ga_1$ |
| 9 | $Pr_{16}Nd_2Fe_{74}B_5Cu_1Ga_1Al_1$ |
| 10 | $Pr_{15}Nd_5Fe_{61}CO_{10}B_7Ag_2$ |

TABLE 5-continued

| No. | Alloy Composition |
|---|---|
| 11 | $Ce_3Pr_{10}Nd_4Fe_{77}B_4Ni_1Zr_1$ |
| 12 | $La_1Pr_{17}Fe_{70}Co_3B_6Cu_3$ |
| 13 | $Dy_5Nd_{11}Fe_{77}B_{5.5}Cu_2$ |
| 14 | $Pr_{14}Tb_{3.5}Fe_{71}CO_5B_{5.5}Au_1$ |
| 15 | $Nd_{17}Fe_{75.5}B_5Ag_{1.5}Ga_1$ |

TABLE 6

| No. | Composition of Magnet |
|---|---|
| 1 | $Pr_{13.5}Fe_{80.2}B_{5.8}$ |
| 2 | $Pr_{14}Fe_{80.2}B_{5.8}$ |
| 3 | $Pr_{14.3}Fe_{79.5}B_{6.2}$ |
| 4 | $Pr_{7.6}Nd_{5.5}Fe_{76.9}Co_5B_5$ |
| 5 | $Pr_{3.6}Nd_{10.5}Fe_{71}Co_9B_{5.7}Cu_{0.2}$ |
| 6 | $Pr_6Nd_{6.7}Fe_{74.9}Co_6B_6Cu_{0.3}Ga_{0.1}$ |
| 7 | $Pr_7Nd_{3.5}Dy_2Fe_{81.4}B_{5.8}Cu_{0.3}$ |
| 8 | $Ce_{1.5}Pr_{10.1}Nd_{1.4}Fe_{55.1}Co_{26.5}B_{5.1}Cu_{0.2}Ga_{0.1}$ |
| 9 | $Pr_{11.2}Nd_{1.4}Fe_{80.8}B_{5.9}Cu_{0.2}Ga_{0.1}A_{10.4}$ |
| 10 | $Pr_{10.5}Nd_{3.4}Fe_{67}Co_{11.5}B_{7.2}Ag_{0.4}$ |
| 11 | $Ce_{2.1}Pr_{8/2}Nd_{3.3}Fe_{80.3}B_{5.2}Ni_{0.4}Zr_{0.6}$ |
| 12 | $La_{0.7}Pr_{11.7}Fe_{77.4}Co_{3.5}B_{6.3}Cu_{0.4}$ |
| 13 | $Dy_{4.2}Nd_{9.2}Fe_{80.8}B_{5.5}Cu_{0.3}$ |
| 14 | $Pr_{9.8}Tb_3Fe_{75.5}Co_{5.5}B_6Au_{0.2}$ |
| 15 | $Nd_{13.2}Fe_{80.6}B_{5.7}Ag_{0.3}Ga_{0.2}$ |

TABLE 7

| | Br(KG) | iHc(KOe) | (BH)max (MGOe) | avg.gr. size(μm) | R-rich phase(%) |
|---|---|---|---|---|---|
| 1 | 12.0 | 7.9 | 29.2 | 25 | 4.1 |
| 2 | 12.3 | 9.6 | 32.7 | 27 | 5.7 |
| 3 | 11.2 | 12.2 | 28.3 | 20 | 6.5 |
| 4 | 10.8 | 11.8 | 26.3 | 23 | 3.7 |
| 5 | 13.0 | 10.5 | 38.1 | 24 | 6.1 |
| 6 | 13.6 | 15.0 | 41.7 | 18 | 3.0 |
| 7 | 13.4 | 13.6 | 40.5 | 20 | 2.8 |
| 8 | 11.9 | 12.5 | 31.9 | 20 | 3.8 |
| 9 | 12.9 | 14.3 | 37.5 | 21 | 3.7 |
| 10 | 12.7 | 6.6 | 29.1 | 30 | 5.9 |
| 11 | 12.6 | 12.2 | 35.8 | 20 | 5.8 |
| 12 | 13.3 | 10.8 | 39.9 | 17 | 2.8 |
| 13 | 13.5 | 14.6 | 42.0 | 15 | 4.6 |
| 14 | 13.9 | 16.6 | 42.5 | 20 | 2.7 |
| 15 | 14.0 | 8.8 | 37.7 | 25 | 4.5 |

Embodiment 5

An alloy having a composition of $Pr_{15}Nd_2Fe_{76.5}B_5Cu_{1.5}$ was melted and cast employing the same raw materials described in the embodiments 1–4.

Then, the cast ingot was worked by methods such as hot-pressing, rolling, or extruding at a temperature of between 900° and 1000° C. as shown in Table 8.

Figure 8:
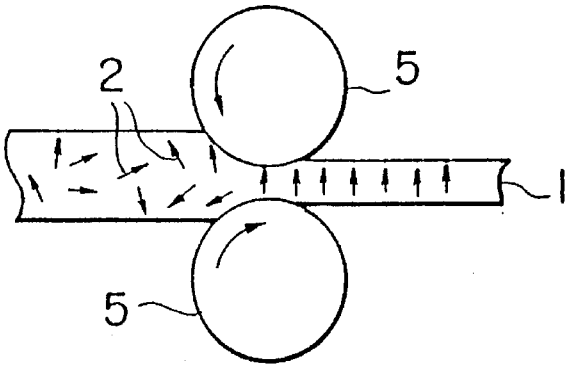
FIG. 8 is a diagrammatic view of a roll working process.
Figure 9:
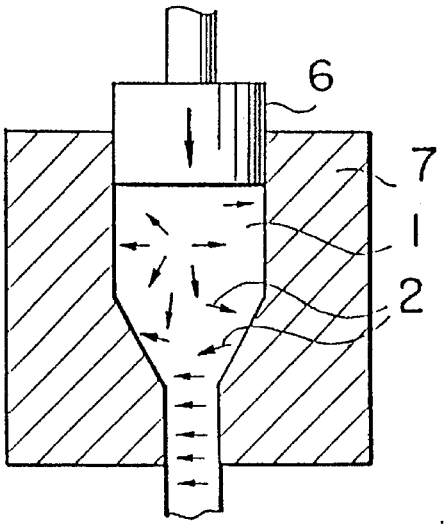
FIG. 9 is a schematic view of an extrusion process.

FIG. 8 and FIG. 9 show illustrations of the hot-rolling and extrusion. In FIG. 8, rolls 5 are shown, and in FIG. 9, an hydraulic press 6 and dies are shown.

In the hot-pressing and hot rolling, respectively, the press 3 and the rolls 5 are adjusted to give a low strain rate. Also, each process is controlled to arrange that the easy magnetization axis of the crystal grains is aligned parallel to the compression direction of the alloy in the high temperature region of the working apparatus as shown by the arrows in FIGS. 2(*b*), 8 and 9.

Then, annealing at 1000° C. for 24 hours is carried out and the material is then cut and polished to measure its magnetic properties.

In table 9 the composition of the magnets, and in table 10 the magnetic property of these magnets, are shown respectively.

As shown in Tables 8–10, the magnetic properties are enhanced by all working processes including hot-pressing, rolling and extrusion.

TABLE 8

| working method | Sample No. | Working method | degree of thickness reduction (%) | strain rate (/sec.) | temp. (°C.) |
|---|---|---|---|---|---|
| 1 | 16 | hot pressing | 80 | $10^{-4}$~$10^{-5}$ | 950 |
| 2 | 17 | hot pressing | 80 | $10^{-2}$~$10^{-3}$ | 1000 |
| 3 | 18 | rolling | 60 | 1~10 | 900 |
| 4 | 19 | rolling | 45 | 10~100 | 950 |
| 5 | 20 | extrusion | 80 | $10^{-1}$ | 950 |

TABLE 9

| | Magnet composition |
|---|---|
| 16 | $Pr_{11.2}Nd_{1.3}Fe_{81.4}B_6Cu_{0.1}$ |
| 17 | $Pr_{12.2}Nd_{1.6}Fe_{80}B_{5.8}Cu_{0.4}$ |
| 18 | $Pr_{13.8}Nd_{1.8}Fe_{78.4}B_{5.3}Cu_{0.7}$ |
| 19 | $Pr_{14.9}Nd_{2.0}Fe_{76.7}B_{5.0}Cu_{0.9}$ |
| 20 | $Pr_{11.0}Nd_{1.2}Fe_{81.7}B_{6.1}Cu_{0.0}$ |

TABLE 10

| | Several Properties of Magnet(s) | | | | |
|---|---|---|---|---|---|
| | Br (KG) | iHc (KOe) | (BH) (MGOe) | Avg. particle size (μm) | R-rich phase (%) |
| 16 | 13.9 | 12.2 | 43.6 | 21 | 2.4 |
| 17 | 11.4 | 12.7 | 29.3 | 22 | 5.0 |
| 18 | 10.9 | 14.7 | 26.8 | 17 | 6.5 |
| 19 | 9.8 | 16.6 | 21.2 | 13 | 10.1 |
| 20 | 11.9 | 8.8 | 28.6 | 27 | 5.6 |

Embodiment 6

A magnet made by the method described in embodiment 1 in accordance with the invention and a conventional sintered magnet are provided of the same composition ($Nd_{15}Fe_{77}B_5$) and of the same form and are introduced into a thermo-hygrostat kept at 40° C. and 95% relative humidity and checked for weight change. The results are shown in FIG. 10.

Figure 10:
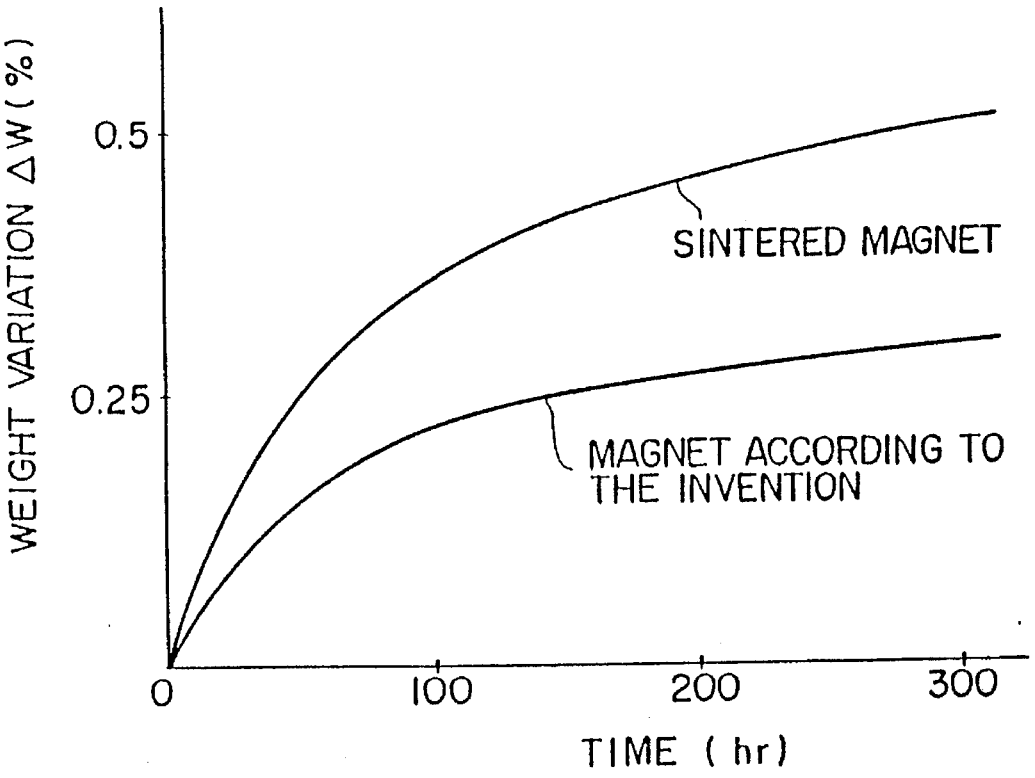
FIG. 10 shows weight variations of a magnet according to the invention and a traditional magnet.

As shown in FIG. 10, relative to the conventional magnet (sintered magnet), the magnet in accordance with the invention has a lower weight change which indicates that it has a lower oxygen concentration. This is a great difference between the two kinds of magnets.

From these embodiments, it is obvious that the inventive permanent magnets have a high coercive force and can be provided with anisotropic properties by means of hot working such as hot-pressing, and the maximum (BH) max value of the magnets reaches the value of 43.6 MGOe.

What is claimed is:

1. A method of manufacturing permanent magnet material comprising the steps of:

melting and casting raw materials to make an ingot having a composition comprising R (R being at least one element selected from the group consisting of rare-earth elements including Y), M (M being Fe and at least one additive element from the group consisting of Cu, Ag and Au, or Fe and at least one additive element selected from the group consisting of Cu, Ag and Au as well as at least one additive element selected from the group consisting of Co, Ni, and Zr), and X (X being only B or B and at least one element selected from the group consisting of Ga and Al); and hot working said ingot at a temperature between 800° C. and 1050° C. in an open die to sufficiently reduce the volume of an R-rich liquid phase to concentrate a magnetic phase in a center portion of said hot work ingot to make said ingot anisotropic.

2. The method of manufacturing permanent magnet material according to claim 1, wherein said raw material consists of from 12 to 25 atomic % of R, from 65 to 85 atomic % of M and from 3 to 10 atomic % of X, wherein grain diameters of crystals after said hot working is from 0.3 μm to 150 μm, and the volume of said R-rich liquid phase is less than 10% (not including 0%), and wherein said R is at least one rare-earth element selected from the group consisting of Pr, Nd, Dy, Ce, La, Y and Tb.

3. The method of manufacturing permanent magnet material according to claim 1, wherein after the hot working, the hot worked ingot is heat treated.

4. The method of manufacturing permanent magnet material according to claim 1, wherein said hot working is selected from at least one of the group consisting of hot pressing, hot rolling and hot extruding.

5. The method of manufacturing permanent magnet material according to claim 2, wherein after the hot working, the hot worked ingot is heat treated.

6. The method of manufacturing permanent magnet material according to claim 2, wherein said hot working is selected from at least one of the group consisting of hot pressing, hot rolling and hot extruding.

7. The method of manufacturing permanent magnet material according to claim 3, wherein said hot working is selected from at least one of the group consisting of hot pressing, hot rolling and hot extruding.

8. The method of manufacturing permanent magnet material according to claim 5, wherein said hot working is selected from at least one of the group consisting of hot pressing, hot rolling and hot extruding.

* * * * *